US011143175B2

(12) United States Patent
Asahara et al.

(10) Patent No.: US 11,143,175 B2
(45) Date of Patent: Oct. 12, 2021

(54) PRESSURE BOOSTER AND CYLINDER APPARATUS PROVIDED WITH SAME

(71) Applicant: SMC CORPORATION, Chiyoda-ku (JP)

(72) Inventors: Hiroyuki Asahara, Tsukubamirai (JP); Kazutaka Someya, Tsukubamirai (JP)

(73) Assignee: SMC CORPORATION, Chiyoda-ku (JP)

( * ) Notice: Subject to any disclaimer, the term of this patent is extended or adjusted under 35 U.S.C. 154(b) by 8 days.

(21) Appl. No.: 16/607,906

(22) PCT Filed: Mar. 5, 2018

(86) PCT No.: PCT/JP2018/008268
§ 371 (c)(1),
(2) Date: Oct. 24, 2019

(87) PCT Pub. No.: WO2018/198535
PCT Pub. Date: Nov. 1, 2018

(65) Prior Publication Data

US 2021/0102558 A1 Apr. 8, 2021

(30) Foreign Application Priority Data

Apr. 28, 2017 (JP) ..... JP2017-089359

(51) Int. Cl.
*F15B 15/22* (2006.01)
*F04B 39/00* (2006.01)
*F04B 7/00* (2006.01)
*F04B 9/127* (2006.01)
(Continued)

(52) U.S. Cl.
CPC ..... *F04B 39/0016* (2013.01); *F04B 7/0073* (2013.01); *F04B 9/127* (2013.01);
(Continued)

(58) Field of Classification Search
CPC ..... F04B 7/0073; F04B 9/127; F04B 37/12; F04B 39/0016; F04B 53/12; F15B 3/00; F15B 15/225; F15B 2211/21
(Continued)

(56) References Cited

U.S. PATENT DOCUMENTS 3,654,834 A * 4/1972 Sifri ..... F15B 15/225 91/399
3,783,620 A * 1/1974 Moe ..... F15B 11/22 60/547.1
(Continued)

FOREIGN PATENT DOCUMENTS

CN 104912855 A 9/2015
FR 2539822 A1 * 7/1984 ..... F04B 41/06
(Continued)

OTHER PUBLICATIONS

International Search Report dated May 29, 2018 in PCT/JP2018/008268 filed on Mar. 5, 2018.
(Continued)

*Primary Examiner* — F Daniel Lopez
*Assistant Examiner* — Matthew Wiblin
(74) *Attorney, Agent, or Firm* — Oblon, McClelland, Maier & Neustadt, L.L.P.

(57) ABSTRACT

A pressure booster constituting a cylinder apparatus is provided with a first piston and a second piston that are coupled to each other by a rod. A connection member provided to the second piston is configured so as to be displaceable from a connection position to a blocking position as a result of the connection member making contact with a cylinder body when the second piston is displaced in a direction where a boosting chamber contracts, and so as to be displaceable from the blocking position to the connection position as a result of the connection member making
(Continued)

contact with the cylinder body when the second piston is displaced in a direction where the boosting chamber expands.

8 Claims, 7 Drawing Sheets

(51) Int. Cl.
*F04B 37/12* (2006.01)
*F04B 53/12* (2006.01)
*F15B 3/00* (2006.01)

(52) U.S. Cl.
CPC ..... *F04B 37/12* (2013.01); *F04B 53/12* (2013.01); *F15B 3/00* (2013.01); *F15B 15/225* (2013.01); *F15B 2211/21* (2013.01); *F15B 2211/40515* (2013.01); *F15B 2211/7053* (2013.01)

(58) Field of Classification Search
USPC ..... 91/342
See application file for complete search history.

(56) References Cited

U.S. PATENT DOCUMENTS 4,051,877 A * 10/1977 Fletcher ..... F04B 9/127 141/4
5,012,643 A * 5/1991 Higami ..... F01B 17/02 251/65
5,092,745 A * 3/1992 Graham ..... F04B 9/127 417/387
5,425,305 A * 6/1995 Mauritz ..... F15B 15/204 251/325
6,170,383 B1 * 1/2001 Mauritz ..... F15B 15/1447 91/399
7,918,154 B2 4/2011 Igarashi
8,683,910 B1 * 4/2014 Foster ..... F01L 11/06 91/229
2007/0193797 A1 * 8/2007 Shamis ..... F04B 9/127 180/165
2014/0072454 A1 3/2014 Roberts
2019/0316582 A1 * 10/2019 Wu ..... F16N 13/02

FOREIGN PATENT DOCUMENTS

JP 3-42075 U 4/1991
JP 2008-223841 A 9/2008
JP 2013-7407 A 1/2013
TW M528226 U 9/2016
TW M528228 U 9/2016

OTHER PUBLICATIONS

Office Action dated Mar. 3, 2021 issued in corresponding Indian patent application No. 201947048264 (with English translation).

* cited by examiner

PRESSURE BOOSTER AND CYLINDER APPARATUS PROVIDED WITH SAME

TECHNICAL FIELD

The present invention relates to a pressure booster that increases the pressure of fluid and outputs the fluid, and to a cylinder apparatus provided with the pressure booster.

BACKGROUND ART

A pressure booster described in, for example, Japanese Laid-Open Utility Model Publication No. 03-042075 has been known. This pressure booster includes a cylinder main body having two cylinder chambers divided by a division wall. A first piston disposed in one cylinder chamber and a second piston disposed in the other cylinder chamber are coupled to each other by a rod passing through the division wall.

In the one cylinder chamber, a first driving chamber and a first pressure boosting chamber are provided. The first driving chamber is located on the side opposite to the division wall with the first piston placed between the first driving chamber and the division wall and the first pressure boosting chamber is located between the first piston and the division wall. In the other cylinder chamber, a second pressure boosting chamber and a second driving chamber are provided. The second pressure boosting chamber is located between the second piston and the division wall and the second driving chamber is located on the side opposite to the division wall with the second piston placed between the second driving chamber and the division wall.

The first driving chamber and the second driving chamber selectively communicate with, via a switching valve, an introduction port which introduces fluid thereinto and an atmospheric port that makes the chambers open to the atmosphere. The first pressure boosting chamber and the second pressure boosting chamber communicate with the introduction port and communicate with a lead-out port for leading the pressurized fluid out of the chambers. The switching valve is provided in the division wall and has a push rod biased by a spring so as to protrude into each of the first pressure boosting chamber and the second pressure boosting chamber. In addition, the switching valve is configured so that a channel thereof switches as a result of the push rod being pressed by the first piston or the second piston.

SUMMARY OF INVENTION

In the above-described pressure booster, since the channel of the switching valve is switched by reciprocating the first piston and the second piston by the fluid which is introduced into the pressure booster, it is possible to achieve energy consumption reductions compared to a case where the switching valve is configured as a solenoid switching valve.

However, this pressure booster needs the switching valve provided with the push rod biased by the spring, which makes the configuration of the pressure booster complicated.

The present invention has been made in view of this problem and an object thereof is to provide a pressure booster that can achieve energy consumption reductions with a simple configuration and a cylinder apparatus provided with the pressure booster.

To attain the above-described object, a pressure booster according to the present invention includes: a cylinder main body having two cylinder chambers divided by a division wall; a first piston slidably disposed in one cylinder chamber of the two cylinder chambers and dividing an inside of the one cylinder chamber into a pressure boosting chamber and a first chamber; a second piston slidably disposed in another cylinder chamber of the two cylinder chambers and dividing an inside of the other cylinder chamber into a second chamber and a third chamber; a rod provided so as to pass through the division wall and configured to couple the first piston and the second piston to each other; and a biasing member configured to bias at least one of the first piston and the second piston in a direction in which the first piston moves toward the pressure boosting chamber. The cylinder main body is provided with a first introduction port configured to introduce fluid into the pressure boosting chamber, a first atmospheric port configured to make an inside of the first chamber open to an atmosphere, a second introduction port configured to introduce the fluid into the second chamber, a second atmospheric port configured to make an inside of the third chamber open to the atmosphere, and a lead-out port configured to lead the fluid pressurized in the pressure boosting chamber out of the pressure boosting chamber. The second piston is provided with a communicating member having a communicating hole configured to make the second chamber and the third chamber communicate with each other, the communicating member being configured to be displaced to a communicating position in which the second chamber and the third chamber communicate with each other via the communicating hole and an interruption position in which a communicating state between the second chamber and the third chamber is interrupted. The communicating member is configured to be displaced from the communicating position to the interruption position as a result of the communicating member making contact with the cylinder main body when the first piston and the second piston are displaced in a direction in which the pressure boosting chamber contracts, and the communicating member is configured to be displaced from the interruption position to the communicating position as a result of the communicating member making contact with the cylinder main body when the first piston and the second piston are displaced in a direction in which the pressure boosting chamber expands.

With this configuration, in a state in which the communicating member is located in the interruption position, the fluid is supplied to the pressure boosting chamber from the first introduction port and the fluid is introduced into the second chamber from the second introduction port. As a result, the first piston and the second piston are displaced against the biasing force of the biasing member in a direction in which the pressure boosting chamber and the second chamber expand. Then, when the communicating member is displaced from the interruption position to the communicating position, the second chamber and the third chamber communicate with each other. As a result, the first piston and the second piston are pushed back by the biasing force of the biasing member in a direction in which the pressure boosting chamber and the second chamber contract, which causes the fluid inside the pressure boosting chamber to be pressurized and led out of the lead-out port. As described above, since it is possible to increase the pressure of the fluid by the fluid itself which is supplied to the pressure booster, the energy consumed by the pressure booster can be reduced. Moreover, since the communicating member having the communicating hole is displaced to the communicating position and the interruption position as a result of the communicating member making contact with the cylinder main body, it is possible to simplify the configuration of the pressure booster.

In the above-described pressure booster, a through hole passing through the second piston in a direction of an axis thereof may be formed in the second piston, and the communicating member may be displaced to the communicating position and the interruption position by moving in the through hole in the direction of the axis.

This configuration makes it possible to displace the communicating member to the communicating position and the interruption position with a simple configuration.

In the above-described pressure booster, the communicating member may include a main body portion extending in the direction of the axis of the second piston and a seal member provided on an outer periphery of one end of the main body portion. The communicating hole may include a first hole formed on the outer periphery of an intermediate portion of the main body portion and a second hole formed at the other end of the main body portion. In a state in which the communicating member is located in the interruption position, the seal member may be in airtight contact with a wall surface that forms the through hole, and in a state in which the communicating member is located in the communicating position, the seal member may be away from the wall surface that forms the through hole.

This configuration makes it possible to interrupt the communicating state between the second chamber and the third chamber by the seal member.

In the above-described pressure booster, the main body portion may be configured to be located in a position closer to one side than the second piston so that one end face of the main body portion is configured to make contact with the cylinder main body in a state in which the communicating member is located in the communicating position, and the main body portion may be configured to be located in a position closer to another side than the second piston so that another end face of the main body portion is configured to make contact with the cylinder main body in a state in which the communicating member is located in the interruption position.

This configuration makes it possible to displace the communicating member from the communicating position to the interruption position as a result of the one end face of the main body portion making contact with the cylinder main body and displace the communicating member from the interruption position to the communicating position as a result of the other end face of the main body portion making contact with the cylinder main body.

In the above-described pressure booster, in the main body portion, the other end face of the main body portion may be located in a position closer to the other side than the second piston in a state in which the communicating member is located in the communicating position and the second hole may be formed in a side face of the other end of the main body portion.

With this configuration, since the second hole is formed in the side face of the other end of the main body portion, it is possible to prevent the communicating hole from being closed by the cylinder main body in a state in which the communicating member is displaced from the interruption position to the communicating position as a result of the other end face of the main body portion making contact with the cylinder main body.

In the above-described pressure booster, the communicating member may include a separation preventing portion that prevents separation of the communicating member from the through hole.

This configuration makes it possible to prevent the communicating member from separating from the through hole of the second piston.

A cylinder apparatus according to the present invention includes: the above-described pressure booster; a fluid pressure cylinder having a piston that divides an inside of a cylinder portion into a first cylinder chamber and a second cylinder chamber and that is configured to reciprocate and slide in the cylinder portion; a supply channel configured to supply fluid to an inside of the first cylinder chamber; a first introduction channel configured to guide the fluid discharged from the fluid pressure cylinder to the first introduction port of the pressure booster; a second introduction channel configured to guide the fluid discharged from the fluid pressure cylinder to the second introduction port of the pressure booster; and a recovery channel configured to guide pressurized fluid led out of a lead-out port of the pressure booster to the supply channel.

This configuration makes it possible to obtain the cylinder apparatus that produces an effect similar to that of the above-described pressure booster. Moreover, since it is possible to pressurize the fluid discharged from the fluid pressure cylinder by the pressure booster and use the fluid again for driving the fluid pressure cylinder, the energy consumed by the cylinder apparatus can be reduced.

In the above-described cylinder apparatus, the first introduction channel may be provided with a first check valve configured to permit circulation of the fluid flowing to the first introduction port from the first introduction channel and check circulation of the fluid flowing to the first introduction channel from the first introduction port; the second introduction channel may be provided with a second check valve configured to permit circulation of the fluid flowing to the second introduction port from the second introduction channel and check circulation of the fluid flowing to the second introduction channel from the second introduction port; and the recovery channel may be provided with a third check valve configured to permit circulation of the fluid flowing to the recovery channel from the lead-out port and check circulation of the fluid flowing to the lead-out port from the recovery channel.

This configuration makes it possible to pressurize the fluid inside the pressure boosting chamber efficiently with a simple configuration.

According to the present invention, since it is possible to increase the pressure of the fluid by the fluid itself which is supplied to the pressure booster, the energy consumed by the pressure booster can be reduced. Moreover, since the communicating member having the communicating hole is displaced to the communicating position and the interruption position as a result of the communicating member making contact with the cylinder main body, it is possible to simplify the configuration of the pressure booster.

The above object, features, and advantages will become more apparent from the following description of a preferred embodiment when taken in conjunction with the accompanying drawings.

DESCRIPTION OF EMBODIMENTS

Hereinafter, a preferred embodiment of a pressure booster 10 according to the present invention will be described in connection with a cylinder apparatus 12 with reference to the accompanying drawings.

Figure 1:
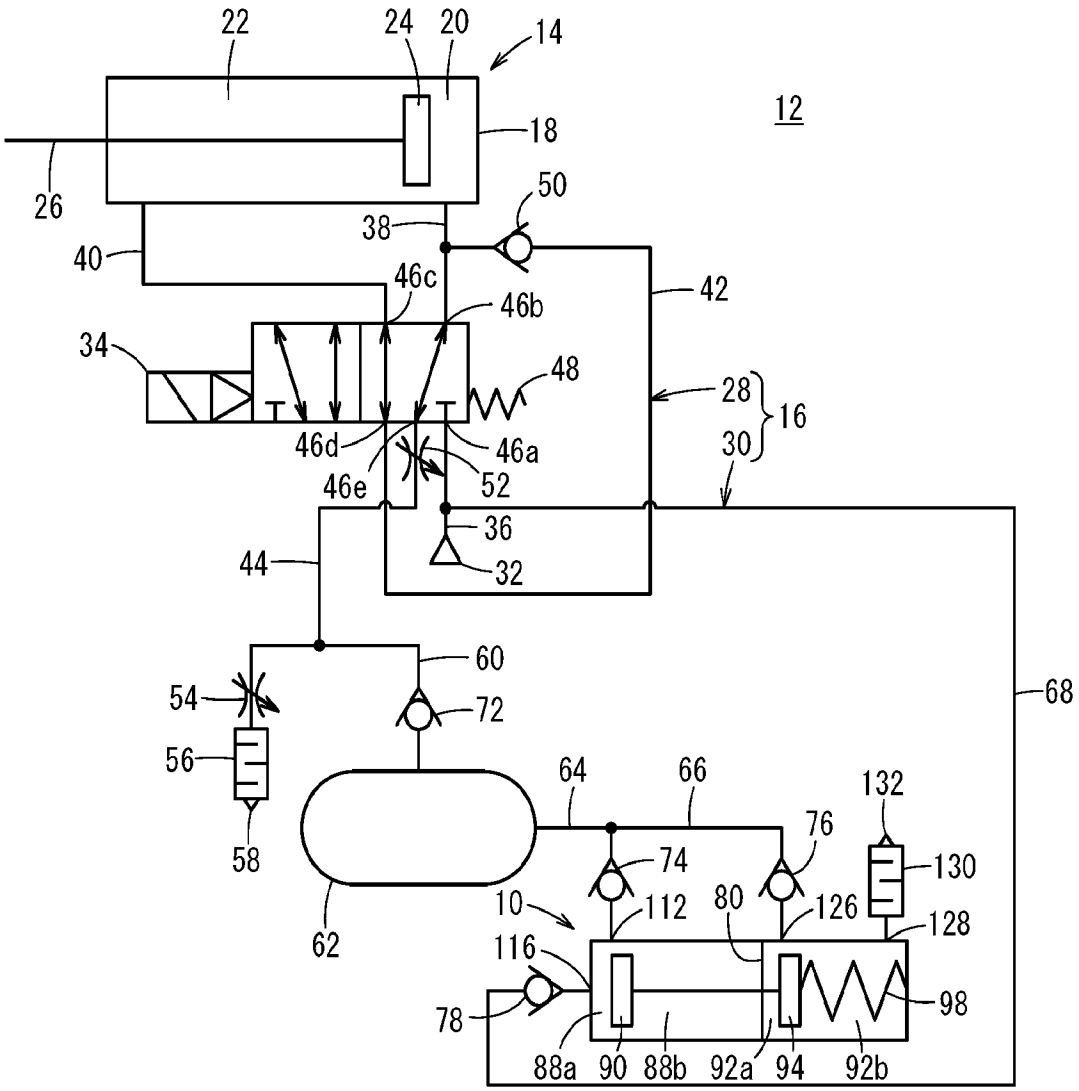
FIG. 1 is a schematic diagram of a cylinder apparatus according to an embodiment of the present invention.

As shown in FIG. 1, the cylinder apparatus 12 according to an embodiment of the present invention includes a fluid pressure cylinder 14 and a cylinder drive unit 16 for driving the fluid pressure cylinder 14.

The fluid pressure cylinder 14 has a piston 24 that divides the inside of a cylinder portion 18 into a first cylinder chamber 20 and a second cylinder chamber 22 and can reciprocate and slide in the cylinder portion 18 by the action of fluid pressure. The other end of a piston rod 26, whose one end is coupled to the piston 24, extends to the outside from the cylinder portion 18. The fluid pressure cylinder 14 does work such as positioning of an unillustrated workpiece when the piston rod 26 is pushed out (extended) and does not do work when the piston rod 26 is retracted. The first cylinder chamber 20 is a driving pressure chamber located on the side opposite to the piston rod 26, and the second cylinder chamber 22 is a return-side pressure chamber located on the side where the piston rod 26 is located.

The cylinder drive unit 16 includes a driving circuit 28 and a pressure boosting circuit 30. The driving circuit 28 supplies driving fluid to the fluid pressure cylinder 14, and the fluid discharged from the fluid pressure cylinder 14 is guided to the driving circuit 28. The driving circuit 28 has a supply source 32, a switching valve 34, a supply channel 36, a first connecting channel 38, a second connecting channel 40, a third connecting channel 42, and a discharge channel 44.

The supply source 32 supplies high-pressure fluid and is configured as a compressor, for example. The switching valve 34 has first to fifth ports 46*a* to 46*e* and is configured as a solenoid valve that can switch between a first position and a second position. The first port 46*a* communicates with the supply source 32 via the supply channel 36. The second port 46*b* communicates with the first cylinder chamber 20 via the first connecting channel 38. The third port 46*c* communicates with the second cylinder chamber 22 via the second connecting channel 40. The fourth port 46*d* communicates with the third connecting channel 42. The fifth port 46*e* communicates with the discharge channel 44.

When the switching valve 34 is in the second position, the second port 46*b* and the fifth port 46*e* communicate with each other and the third port 46*c* and the fourth port 46*d* communicate with each other, and the first port 46*a* is closed. When the switching valve 34 is in the first position, the first port 46*a* and the second port 46*b* communicate with each other and the third port 46*c* and the fifth port 46*e* communicate with each other, and the fourth port 46*d* is closed (see FIG. 7). When the switching valve 34 is not energized, the switching valve 34 is held in the second position by the biasing force of a spring 48; when the switching valve 34 is energized, the switching valve 34 switches from the second position to the first position. Energization of the switching valve 34 is performed in response to output of an energization command from a programmable logic controller (PLC), which is an unillustrated higher-level device, to the switching valve 34. Non-energization of the switching valve 34 is performed in response to output of a non-energization command from the PLC to the switching valve 34.

The supply channel 36 introduces the fluid of the supply source 32 into the first cylinder chamber 20. The third connecting channel 42 connects the first connecting channel 38 and the second connecting channel 40 to each other. In the third connecting channel 42, a check valve 50 is provided. The check valve 50 permits the circulation of the fluid flowing to the second connecting channel 40 from the first connecting channel 38 and checks the circulation of the fluid flowing to the first connecting channel 38 from the second connecting channel 40.

In the discharge channel 44, a first throttle valve 52, a second throttle valve 54, a silencer 56, and an exhaust port 58 are provided. The first throttle valve 52 is configured as a variable throttle valve that can vary the channel cross-sectional area and is provided to regulate the rate of flow of the fluid flowing to the third connecting channel 42 from the first connecting channel 38 when the switching valve 34 is in the second position.

The second throttle valve 54 is located downstream of the first throttle valve 52 in the discharge channel 44 (the side opposite to the side where the switching valve 34 is located). The second throttle valve 54 is configured as a variable throttle valve that can vary the channel cross-sectional area. The silencer 56 is located downstream of the second throttle valve 54 in the discharge channel 44. The silencer 56 reduces exhaust noise of the fluid which is discharged into the atmosphere from the exhaust port 58.

The pressure boosting circuit 30 pressurizes the fluid discharged into the discharge channel 44 of the driving circuit 28 from the fluid pressure cylinder 14 and returns the fluid to the supply channel 36 of the driving circuit 28. The pressure boosting circuit 30 has a connecting channel 60, a tank 62, a first introduction channel 64, a second introduction channel 66, a recovery channel 68, and a pressure booster 10.

The connecting channel 60 connects a point between the first throttle valve 52 and the second throttle valve 54 in the discharge channel 44, and the tank 62 to each other. In the connecting channel 60, a check valve 72 is provided. The check valve 72 permits the circulation of the fluid flowing to the tank 62 from the discharge channel 44 and checks the circulation of the fluid flowing to the discharge channel 44 from the tank 62. The tank 62 stores the fluid which is guided to the pressure booster 10 from the discharge channel 44 and is configured as an air tank, for example.

The first introduction channel 64 guides, to a first introduction port 112 of the pressure booster 10, the fluid discharged from the fluid pressure cylinder 14. The first introduction channel 64 connects the tank 62 and the first introduction port 112 of the pressure booster 10 to each other. In the first introduction channel 64, a first check valve 74 is provided. The first check valve 74 permits the circulation of the fluid flowing to the first introduction port 112 from the first introduction channel 64 (the tank 62) and checks the circulation of the fluid flowing to the first introduction channel 64 (the tank 62) from the first introduction port 112.

The second introduction channel 66 guides, to a second introduction port 126 of the pressure booster 10, the fluid discharged from the fluid pressure cylinder 14. The second introduction channel 66 connects a part of the first introduction channel 64 that is upstream of the first check valve 74 (on the side where the tank 62 is located) and the second introduction port 126 of the pressure booster 10 to each other. In the second introduction channel 66, a second check valve 76 is provided. The second check valve 76 permits the circulation of the fluid flowing to the second introduction port 126 from the second introduction channel 66 (the tank 62) and checks the circulation of the fluid flowing to the second introduction channel 66 (the tank 62) from the second introduction port 126.

The recovery channel 68 guides, to the supply channel 36, the pressurized fluid led out of a lead-out port 116 of the pressure booster 10. The recovery channel 68 connects the lead-out port 116 of the pressure booster 10 and the supply channel 36 to each other. In the recovery channel 68, a third check valve 78 is provided. The third check valve 78 permits the circulation of the fluid flowing to the recovery channel 68 (the supply channel 36) from the lead-out port 116 and checks the circulation of the fluid flowing to the lead-out port 116 from the recovery channel 68 (the supply channel 36).

Figure 2:
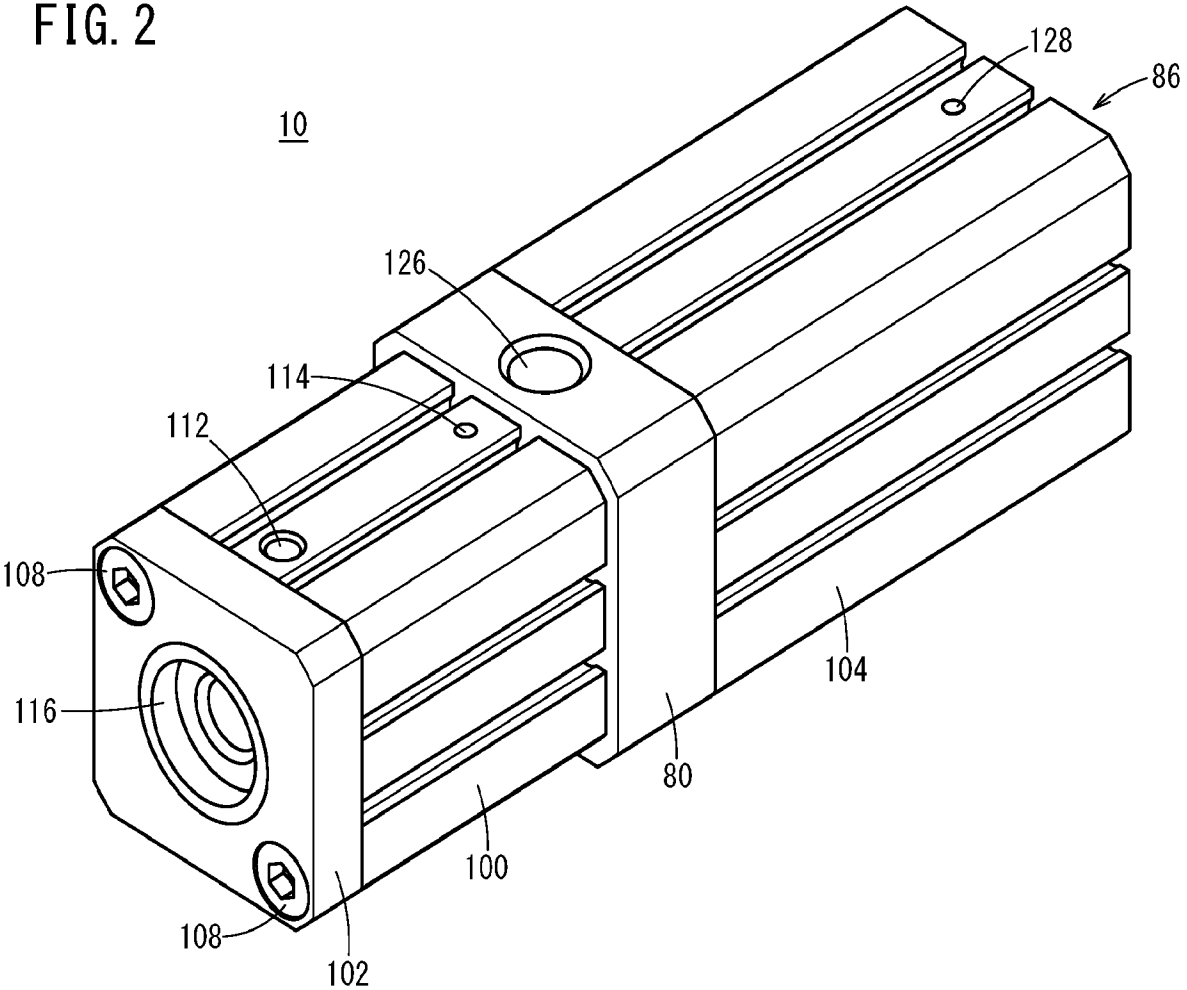
FIG. 2 is a perspective view of a pressure booster of FIG. 1.
Figure 3:
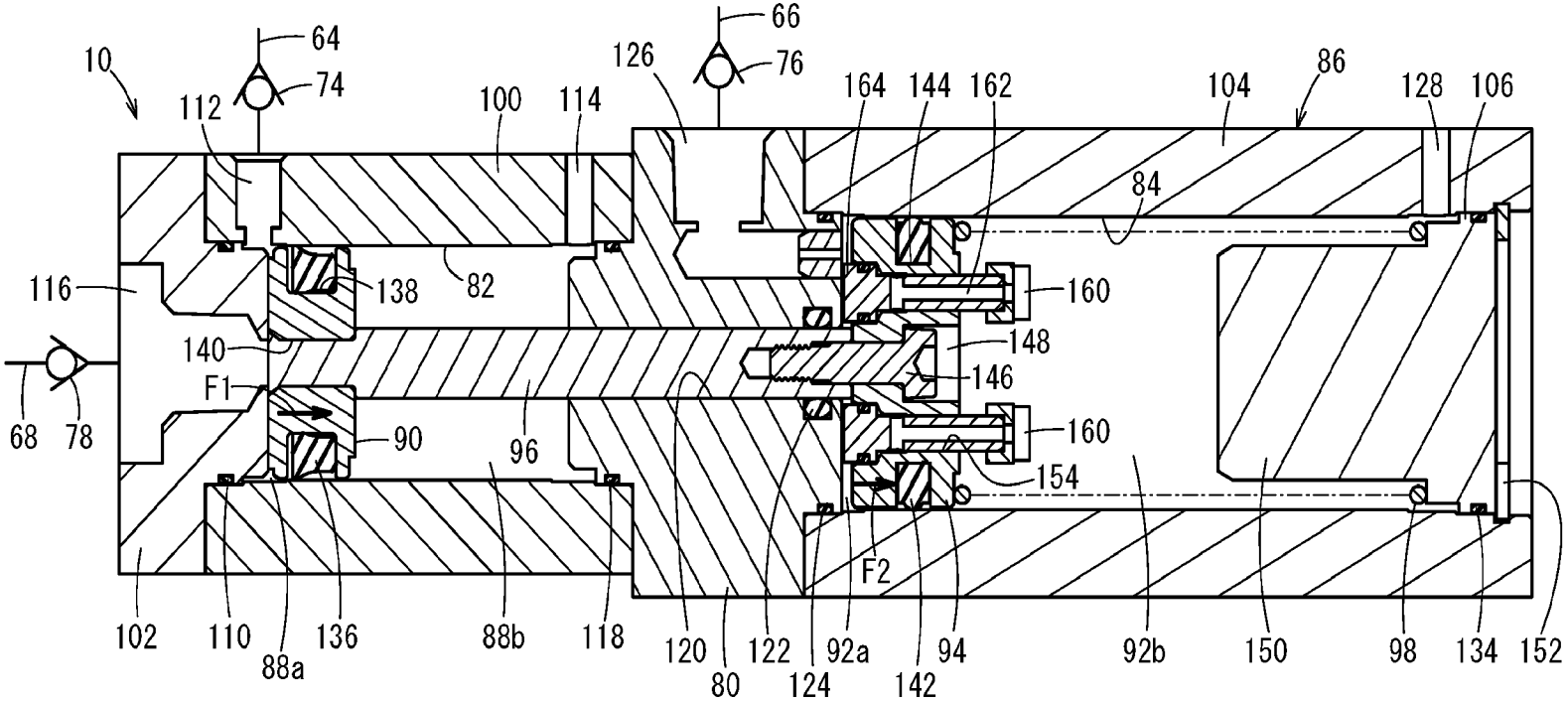
FIG. 3 is a longitudinal sectional view of the pressure booster of FIG. 2.

As shown in FIG. 3, the pressure booster 10 includes: a cylinder main body 86 (see FIG. 2) having two cylinder chambers 82 and 84 divided by a division wall 80; a first piston 90 that is slidably disposed in one cylinder chamber 82 and divides the inside of the one cylinder chamber 82 into a pressure boosting chamber 88*a* and a first chamber 88*b*; a second piston 94 that is slidably disposed in the other cylinder chamber 84 and divides the inside of the other cylinder chamber 84 into a second chamber 92*a* and a third chamber 92*b*; a rod 96 that is provided so as to pass through the division wall 80 and couples the first piston 90 and the second piston 94 to each other; and a biasing member 98 that biases the second piston 94 in a direction in which the first piston 90 moves toward the pressure boosting chamber 88*a*.

The cylinder main body 86 has a first cylinder tube 100, a first end cover 102, the division wall 80, a second cylinder tube 104, and a second end cover 106. The cylinder chamber 82 is formed throughout the length of the first cylinder tube 100. The first end cover 102 is fitted into an opening on the one-end side of the cylinder chamber 82, and the division wall 80 is fitted into an opening on the other-end side of the cylinder chamber 82. The first end cover 102, the first cylinder tube 100, and the division wall 80 are coupled to one another with a fastening member 108 such as a bolt. The first end cover 102 is fitted with a ring-shaped seal member 110 in airtight contact with a wall surface, which forms an opening on the one-end side of the first cylinder tube 100.

The pressure boosting chamber 88*a* is formed between the first end cover 102 and the first piston 90. The first chamber 88*b* is formed between the first piston 90 and the division wall 80. At one end of the first cylinder tube 100, the first introduction port 112 for introducing the fluid into the pressure boosting chamber 88*a* is formed. The first introduction port 112 communicates with the first introduction channel 64. At the other end of the first cylinder tube 100, a first atmospheric port 114 for making the inside of the first chamber 88*b* open to the atmosphere is formed.

In almost the center of the first end cover 102, the lead-out port 116 for leading the fluid pressurized in the pressure boosting chamber 88*a* out of the pressure boosting chamber 88*a* is formed. The lead-out port 116 communicates with the recovery channel 68. The lead-out port 116 is formed so as to pass through the first end cover 102 in a thickness direction. The division wall 80 is fitted with a ring-shaped seal member 118 in airtight contact with a wall surface, which forms an opening on the other-end side of the first cylinder tube 100. In the division wall 80, a rod insertion hole 120 through which the rod 96 is inserted is formed. A wall surface forming the rod insertion hole 120 is fitted with a rod packing 122 in airtight contact with the rod 96.

In the second cylinder tube 104, the cylinder chamber 84 extending throughout the length of the second cylinder tube 104 is formed. The division wall 80 is fitted into an opening on the one-end side of the cylinder chamber 84, and the second end cover 106 is fitted into an opening on the other-end side of the cylinder chamber 84. The second cylinder tube 104 and the division wall 80 are coupled to each other with an unillustrated fastening member such as a bolt. The division wall 80 is fitted with a ring-shaped seal member 124 in airtight contact with a wall surface, which forms an opening on the one-end side of the second cylinder tube 104.

The second chamber 92*a* is formed between the division wall 80 and the second piston 94. The third chamber 92*b* is formed between the second piston 94 and the second end cover 106. In the division wall 80, the second introduction port 126 for introducing the fluid into the second chamber 92*a* is formed. The second introduction port 126 communicates with the second introduction channel 66. The second introduction port 126 is formed in a wall surface, which forms the outer surface of the cylinder main body 86, of the division wall 80 and in a wall surface, which forms the second chamber 92*a*, of the division wall 80. In the second cylinder tube 104, a second atmospheric port 128 communicating with the third chamber 92*b* is formed. In the second atmospheric port 128, an exhaust port 132 is provided via a silencer 130 (see FIG. 1). The second end cover 106 is fitted with a ring-shaped seal member 134 in airtight contact with a wall surface, which forms an opening on the other-end side of the second cylinder tube 104.

On the outer periphery of the first piston 90, a fitting groove 138, into which a ring-shaped piston packing 136 in airtight contact with the inner periphery of the first cylinder tube 100 is fitted, is formed. In the central portion of the first piston 90, an attachment hole 140 in which one end of the rod 96 is attached is formed.

On the outer periphery of the second piston 94, a fitting groove 144, into which a ring-shaped piston packing 142 in airtight contact with the inner periphery of the second cylinder tube 104 is fitted, is formed. In the central portion of the second piston 94, a bolt attachment hole 148 in which a bolt 146 coupling the second piston 94 and the other end of the rod 96 is provided is formed.

The biasing member 98 is a compression spring that biases the second piston 94 toward the side where the division wall 80 is located. The biasing member 98 is disposed in the third chamber 92*b*. The biasing member 98 is inserted between a guide portion 150, which protrudes from the second end cover 106 toward the side where the second piston 94 is located, and the second piston 94. Part of the guide portion 150 is inserted into an inner hole of the biasing member 98. The whole of the second end cover 106 is located in the second cylinder tube 104. In the wall surface forming the opening on the other-end side of the second cylinder tube 104, a snap ring 152 that prevents the movement of the second end cover 106 to the other-end side (the side opposite to the division wall 80) is provided.

Figure 4:
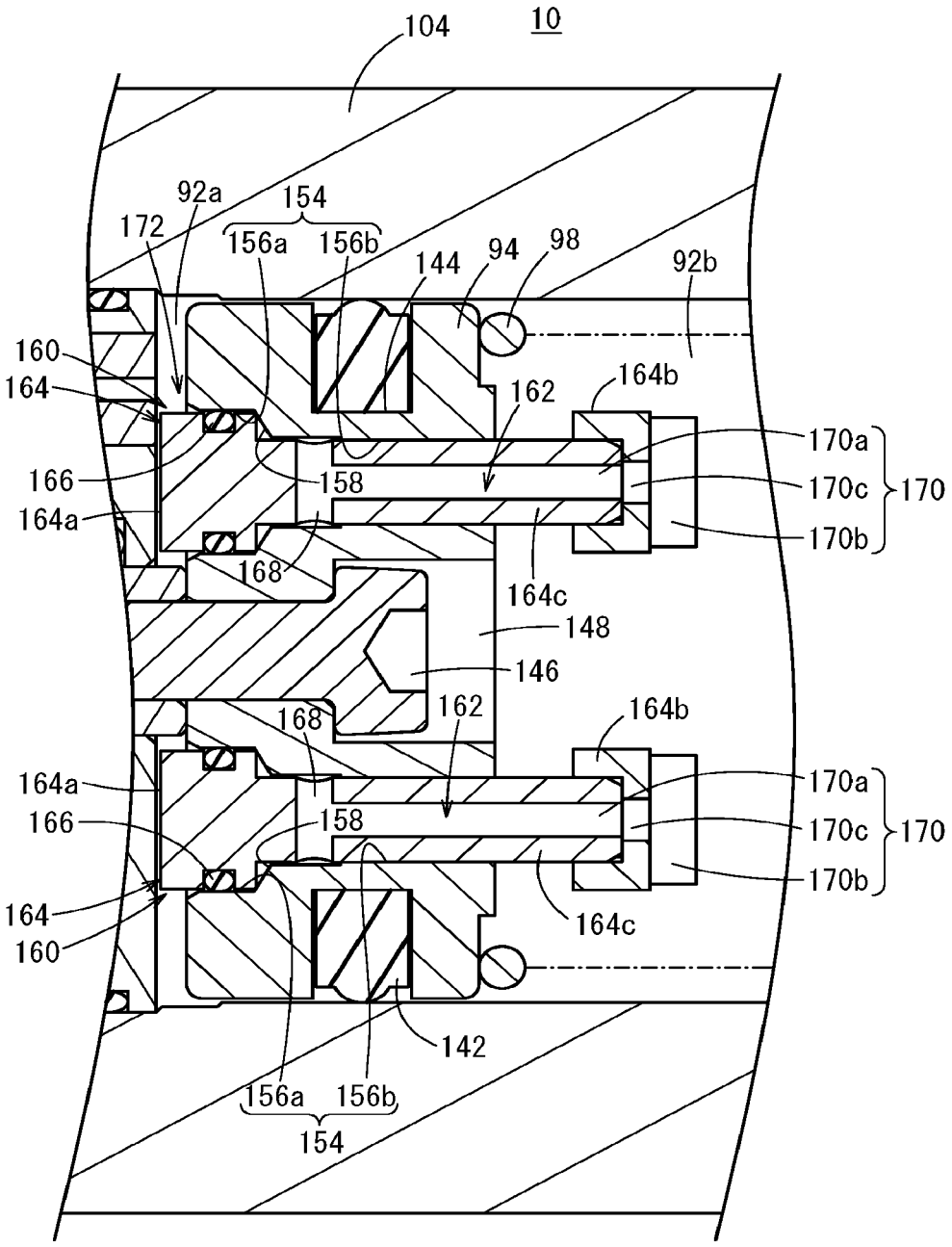
FIG. 4 is a partially enlarged view of FIG. 3.
Figure 5:
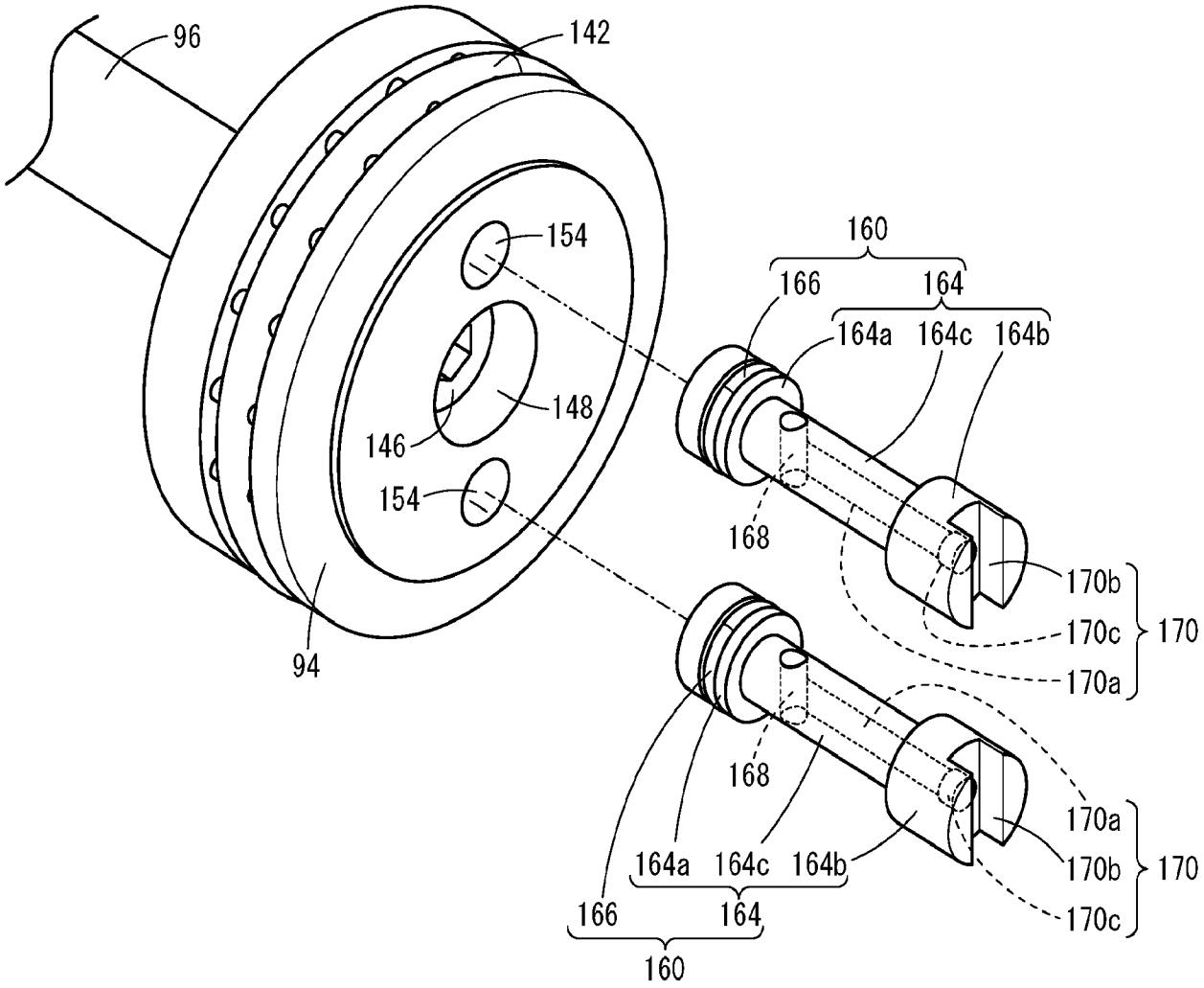
FIG. 5 is an exploded perspective view of a second piston and a communicating member of FIG. 3.

As shown in FIGS. 3 to 5, in the second piston 94, two through holes 154 passing therethrough in a direction of the axis of the second piston 94 are formed. These through holes 154 are provided so as to be symmetric with respect to a point about the axis of the second piston 94. Each through hole 154 includes a large-diameter hole 156*a* which is formed in one face of the second piston 94 in the direction of the axis thereof and a small-diameter hole 156*b* that communicates with the large-diameter hole 156*a* and is formed in the other face of the second piston 94 in the direction of the axis thereof. That is, at a boundary portion between the large-diameter hole 156*a* and the small-diameter hole 156*b*, a step face 158 directed toward the side where the division wall 80 is located is provided.

In each through hole 154, a communicating member 160 is provided so as to be movable in the direction of the axis of the second piston 94. The communicating member 160 includes a main body portion 164 with a communicating hole 162 for making the second chamber 92*a* and the third chamber 92*b* communicate with each other, and a seal member 166 provided in the main body portion 164. The main body portion 164 includes a first large-diameter portion 164*a* which is one end of the main body portion 164, a second large-diameter portion 164*b* which is the other end of the main body portion 164, and a small-diameter intermediate portion 164*c* that couples the first large-diameter portion 164*a* and the second large-diameter portion 164*b* to each other.

The first large-diameter portion 164*a* is configured to be insertable into the large-diameter hole 156*a*. The intermediate portion 164*c* is inserted through the small-diameter hole 156*b*. The second large-diameter portion 164*b* is located in the third chamber 92*b*.

The seal member 166 is attached to the outer periphery of the first large-diameter portion 164*a*. The communicating hole 162 includes a first hole 168 formed on the outer periphery of the intermediate portion 164*c* of the main body portion 164, and a second hole 170 formed in the outer surface of the second large-diameter portion 164*b* of the main body portion 164. The first hole 168 passes through the intermediate portion 164*c* in a direction perpendicular to the direction of the axis of the second piston 94. The second hole 170 includes a long hole 170*a* extending from the first hole 168 to the other end face of the intermediate portion 164*c*, a recess portion 170*b* formed in the end face of the second large-diameter portion 164*b*, and an intermediate hole 170*c* that communicates with the long hole 170*a* and is formed in the bottom face of the recess portion 170*b*. The recess portion 170*b* extends throughout the length of the second large-diameter portion 164*b* in a radial direction thereof. That is, the recess portion 170*b* is formed on the outer periphery of the second large-diameter portion 164*b*.

Figure 6:
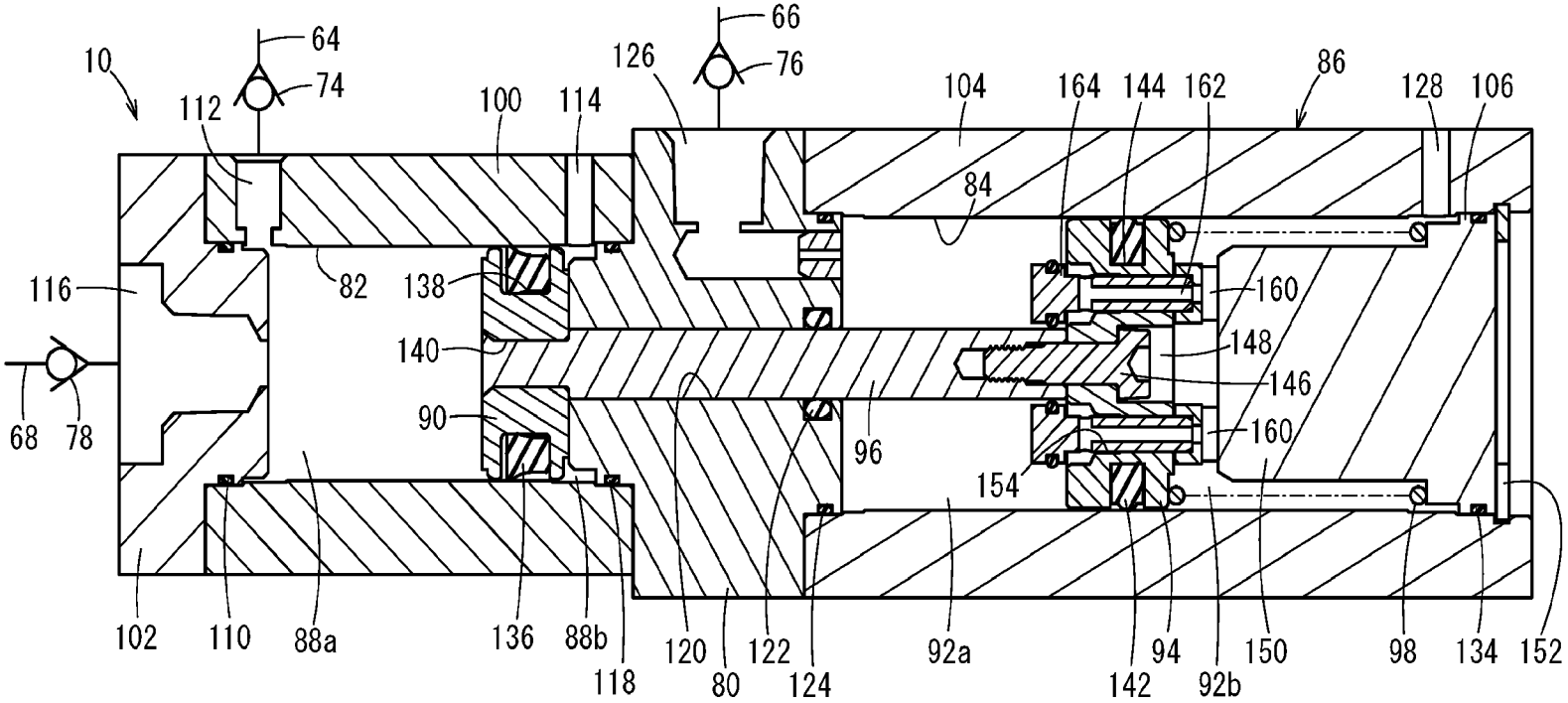
FIG. 6 is a longitudinal sectional view showing a state in which a first piston and the second piston have been displaced in the pressure booster of FIG. 3.

The communicating member 160 is configured to be displaced to a communicating position (a position shown in FIG. 6) in which the second chamber 92*a* and the third chamber 92*b* communicate with each other via the communicating hole 162 and an interruption position (a position shown in FIG. 3) in which a communicating state between the second chamber 92*a* and the third chamber 92*b* is interrupted. That is, as shown in FIG. 6, when the communicating member 160 is located in the communicating position, the first large-diameter portion 164*a* is separated from the large-diameter hole 156*a* into the second chamber 92*a*, whereby the second chamber 92*a* and the third chamber 92*b* communicate with each other via the communicating hole 162 and the large-diameter hole 156*a*. In this situation, the seal member 166 is away from a wall surface forming the large-diameter hole 156*a*. Moreover, as shown in FIG. 3, when the communicating member 160 is located in the interruption position, the seal member 166 makes airtight contact with the wall surface, which forms the large-diameter hole 156*a*, whereby the communicating state between the second chamber 92*a* and the third chamber 92*b* is interrupted.

The communicating member 160 is displaced from the communicating position to the interruption position as a result of the first large-diameter portion 164*a* (the communicating member 160) making contact with the division wall 80 (the cylinder main body 86) when the first piston 90 and the second piston 94 are displaced in a direction (a left side of FIG. 3) in which the pressure boosting chamber 88*a* contracts. In other words, the communicating member 160 switches from the communicating position to the interruption position when the second piston 94 is located at one stroke end. In this situation, as a result of the first large-diameter portion 164*a* making contact with the step face 158, the movement of the communicating member 160 to the other-end side (the side where the guide portion 150 is located) is restricted. The first large-diameter portion 164*a* protrudes into the second chamber 92*a* while in contact with the step face 158.

Moreover, the main body portion 164 is configured to be located in a position closer to the other side than the second piston 94 in such a way that the other end face of the main body portion 164 can make contact with the cylinder main body 86 in a state in which the communicating member 160 is located in the interruption position.

As shown in FIG. 6, the communicating member 160 is displaced from the interruption position to the communicating position as a result of the second large-diameter portion 164*b* (the communicating member 160) making contact with the guide portion 150 (the cylinder main body 86) when the first piston 90 and the second piston 94 are displaced in a direction (a right side of FIG. 6) in which the pressure boosting chamber 88*a* expands. In other words, the communicating member 160 switches from the interruption position to the communicating position when the second piston 94 is located at the other stroke end. In this situation, as a result of the second large-diameter portion 164*b* making contact with the second piston 94, the movement of the communicating member 160 to the one-end side (the side where the division wall 80 is located) is restricted. The second large-diameter portion 164*b* protrudes into the third chamber 92*b* while in contact with the second piston 94.

Furthermore, the main body portion 164 is configured to be located in a position closer to one side than the second piston 94 in such a way that one end face of the main body portion 164 can make contact with the cylinder main body 86 in a state in which the communicating member 160 is located in the communicating position. In this situation, the other end face of the main body portion 164 is located in a position closer to the other side than the second piston 94.

That is, by moving in the through hole 154 in the direction of the axis, the communicating member 160 is displaced to the communicating position and the interruption position. Moreover, in FIG. 4, the communicating member 160 includes a separation preventing portion 172 that prevents separation of the communicating member 160 from the through hole 154.

The separation preventing portion 172 includes the first large-diameter portion 164*a* and the step face 158, and, as a result of the first large-diameter portion 164*a* making contact with the step face 158, the communicating member 160 is prevented from being separated from the through hole 154 into the third chamber 92*b*. The separation preventing portion 172 includes the second large-diameter portion 164*b*, and, as a result of the second large-diameter portion 164*b* making contact with the other face of the second piston 94, the communicating member 160 is prevented from being separated from the through hole 154 into the second chamber 92*a*.

The pressure booster 10 and the cylinder apparatus 12 according to the present embodiment are basically configured as described above; next, the operation thereof (how to use the pressure booster 10 and the cylinder apparatus 12) will be described. In an initial state, as shown in FIG. 1, the piston 24 of the fluid pressure cylinder 14 is located at a stroke end on the side opposite to the piston rod 26, and the switching valve 34 is located in the second position. Moreover, the communicating member 160 of the pressure booster 10 is located in the interruption position (see FIG. 3).

Figure 7:
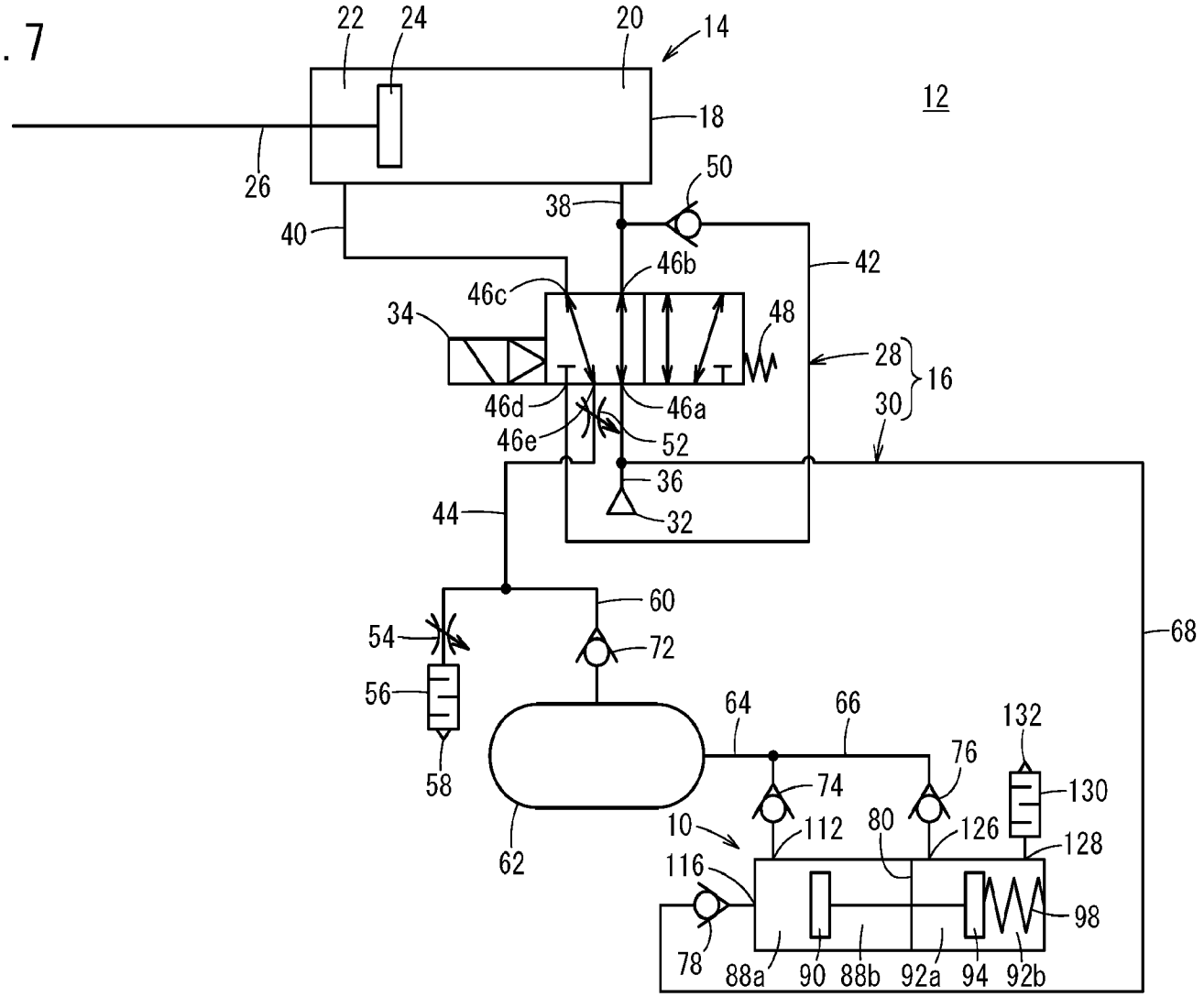
FIG. 7 is a schematic diagram showing a state in which a switching valve of FIG. 1 has been switched.

When a driving process of extending the piston rod 26 is performed in the cylinder apparatus 12, the switching valve 34 is switched from the second position to the first position as shown in FIG. 7. As a result, the high-pressure fluid (compressed air) flows into the first cylinder chamber 20 from the supply source 32 via the supply channel 36, the first port 46*a*, the second port 46*b*, and the first connecting channel 38. This causes the piston 24 to be displaced to the side where the piston rod 26 is located and the piston rod 26 to extend, and the fluid inside the second cylinder chamber 22 is discharged into the discharge channel 44 via the second connecting channel 40, the third port 46*c*, and the fifth port 46*e*. In this situation, since the fourth port 46*d* with which the third connecting channel 42 communicates is closed, the fluid of the supply source 32 is efficiently supplied to the inside of the first cylinder chamber 20. The fluid discharged into the discharge channel 44 from the second cylinder chamber 22 is discharged into the atmosphere via the silencer 56 and the exhaust port 58. It is to be noted that the fluid inside the discharge channel 44 may be stored in the tank 62 by adjusting the channel cross-sectional area of the second throttle valve 54.

Next, when a return process of retracting the piston rod 26 is performed, the switching valve 34 is switched from the first position to the second position as shown in FIG. 1. As a result, the first port 46*a* with which the supply channel 36 communicates is closed, whereby the supply of the fluid to the inside of the first cylinder chamber 20 from the supply source 32 is stopped. Then, the fluid inside the first cylinder chamber 20 is guided to the inside of the second cylinder chamber 22 via the first connecting channel 38, the third connecting channel 42, the fourth port 46*d*, the third port 46*c*, and the second connecting channel 40. This causes the piston 24 to be displaced to the side opposite to the piston rod 26 and the piston rod 26 to be retracted, and the fluid inside the first cylinder chamber 20 is discharged into the first connecting channel 38.

In the return process, the piston 24 is displaced using the fluid discharged from the inside of the first cylinder chamber 20. This eliminates the need to supply the fluid to the inside of the second cylinder chamber 22 from the supply source 32, which reduces power consumption and air consumption of the supply source 32 and thereby reduces the energy consumed by the cylinder apparatus 12.

The fluid discharged into the first connecting channel 38 from the first cylinder chamber 20 is guided to the third connecting channel 42 and is guided to the discharge channel 44 via the second port 46*b* and the fifth port 46*e*. In this situation, by varying the channel cross-sectional area of the first throttle valve 52, the ratio between the rate of flow of the fluid which is guided to the third connecting channel 42 and the rate of flow of the fluid which is guided to the discharge channel 44 is adjusted.

By adjusting the channel cross-sectional area of the second throttle valve 54, the fluid guided to the discharge channel 44 is stored in the tank 62 via the connecting channel 60. This makes it possible to rapidly increase the pressure of the fluid inside the tank 62 so as to be about half the pressure of the fluid which is led out of the supply source 32.

The fluid inside the tank 62 is guided to the inside of the pressure boosting chamber 88*a* via the first introduction channel 64 and the first introduction port 112 and is guided to the inside of the second chamber 92*a* via the second introduction channel 66 and the second introduction port 126. In this situation, since the communicating member 160 is located in the interruption position as shown in FIG. 3, the communicating state between the second chamber 92*a* and the third chamber 92*b* is interrupted. Moreover, since the first port 46*a* with which the supply channel 36 communicates is closed, the pressure of the fluid present in a part, which is closer to the supply channel 36 than the third check valve 78, of the recovery channel 68 becomes higher than the pressure of the fluid inside the tank 62. This prevents the fluid introduced into the pressure boosting chamber 88*a* from the first introduction port 112 from flowing into the recovery channel 68.

The fluid introduced into the pressure boosting chamber 88*a* presses the first piston 90 to the other-end side of the cylinder main body 86 by a force F1. The fluid introduced into the second chamber 92*a* presses the second piston 94 to the other-end side of the cylinder main body 86 by a force F2. As a result, the first piston 90 and the second piston 94 are pressed to the other-end side of the cylinder main body 86 by the resultant of the force F1 and the force F2.

Thus, the first piston 90 and the second piston 94 are displaced to the other-end side of the cylinder main body 86 against the biasing force of the biasing member 98 (with the biasing member 98 being compressed). At this time, the fluid inside the first chamber 88*b* is discharged into the atmosphere via the first atmospheric port 114 and the fluid inside the third chamber 92*b* is discharged into the atmosphere via the second atmospheric port 128. Then, when the other end face of the communicating member 160 makes contact with the protruding end face of a protrusion of the guide portion 150 in FIG. 6, the communicating member 160 moves in the through hole 154 to the side where the division wall 80 is located, and is displaced from the interruption position to the communicating position. This causes the second chamber 92*a* and the third chamber 92*b* to communicate with each other via the communicating hole 162.

When the second chamber 92*a* and the third chamber 92*b* communicate with each other, the pressure inside the second chamber 92*a* and the pressure inside the third chamber 92*b* become equal, which causes the force F2 to stop acting on the second piston 94. Thus, the first piston 90 and the second piston 94 are displaced to the one-end side of the cylinder main body 86 by the biasing force of the biasing member 98. In this situation, the first check valve 74 prevents backflow of the fluid inside the pressure boosting chamber 88*a* to the tank 62, and the second check valve 76 prevents backflow of the fluid inside the second chamber 92*a* to the tank 62. Moreover, the atmosphere flows into the first chamber 88*b* via the first atmospheric port 114 and the fluid inside the second chamber 92*a* flows into the third chamber 92*b*. As a result, the fluid inside the pressure boosting chamber 88*a* is pressurized.

When the pressure of the fluid in the pressure boosting chamber 88*a* becomes higher than or equal to the pressure of the fluid which is led out of the supply source 32 (the pressure of the fluid present in the recovery channel 68 and the supply channel 36), the fluid inside the pressure boosting chamber 88*a* flows into a part, which is closer to the supply channel 36 than the third check valve 78, of the recovery channel 68 and is recovered by the supply channel 36.

Then, when the first piston 90 and the second piston 94 return to the original positions, the fluid inside the tank 62 is introduced into the pressure boosting chamber 88*a* and the second chamber 92*a* and the above-described pressure boosting operation is performed again. That is, in the present embodiment, during the return process of the fluid pressure cylinder 14, the above-described pressure boosting operation of the pressure booster 10 is performed multiple times.

Then, when the driving process of the fluid pressure cylinder 14 is performed, the fluid recovered from the pressure booster 10 is used for driving the piston 24 of the fluid pressure cylinder 14, which reduces the burden on the supply source 32. That is, since electric power consumption and air consumption of the supply source 32 are reduced in the driving process of the fluid pressure cylinder 14, the energy consumed by the cylinder apparatus 12 is reduced.

Next, the operation and effects of the present embodiment will be described below.

The pressure booster 10 includes: the cylinder main body 86 having the two cylinder chambers 82 and 84 divided by the division wall 80; the first piston 90 that is slidably disposed in one cylinder chamber 82 and divides the inside of the one cylinder chamber 82 into the pressure boosting chamber 88*a* and the first chamber 88*b*; the second piston 94 that is slidably disposed in the other cylinder chamber 84 and divides the inside of the other cylinder chamber 84 into the second chamber 92*a* and the third chamber 92*b*; the rod 96 that is provided so as to pass through the division wall 80 and couples the first piston 90 and the second piston 94 to each other; and the biasing member 98 that biases at least one of the first piston 90 and the second piston 94 in a direction in which the first piston 90 moves toward the pressure boosting chamber 88*a*.

The cylinder main body 86 is provided with the first introduction port 112 for introducing the fluid into the pressure boosting chamber 88*a*, the first atmospheric port 114 that makes the inside of the first chamber 88*b* open to the atmosphere, the second introduction port 126 for introducing the fluid into the second chamber 92*a*, the second atmospheric port 128 that makes the inside of the third chamber 92*b* open to the atmosphere, and the lead-out port 116 for leading the fluid pressurized in the pressure boosting chamber 88*a* out of the pressure boosting chamber 88*a*.

The second piston 94 is provided with the communicating member 160 that has the communicating hole 162 for making the second chamber 92*a* and the third chamber 92*b* communicate with each other, and that can be displaced to the communicating position in which the second chamber 92*a* and the third chamber 92*b* communicate with each other via the communicating hole 162 and the interruption position in which the communicating state between the second chamber 92*a* and the third chamber 92*b* is interrupted.

The communicating member 160 is configured to be displaced from the communicating position to the interruption position as a result of the communicating member 160 making contact with the cylinder main body 86 when the first piston 90 and the second piston 94 are displaced in a direction in which the pressure boosting chamber 88*a* contracts, and the communicating member 160 is configured to be displaced from the interruption position to the communicating position as a result of the communicating member 160 making contact with the cylinder main body 86 when the first piston 90 and the second piston 94 are displaced in a direction in which the pressure boosting chamber 88*a* expands.

Thus, in a state in which the communicating member 160 is located in the interruption position, the fluid is supplied to the pressure boosting chamber 88*a* from the first introduction port 112 and the fluid is supplied to the inside of the second chamber 92*a* from the second introduction port 126. As a result, the first piston 90 and the second piston 94 are displaced against the biasing force of the biasing member 98 in a direction in which the pressure boosting chamber 88*a* and the second chamber 92*a* expand. Then, when the communicating member 160 is displaced from the interruption position to the communicating position, the second chamber 92*a* and the third chamber 92*b* communicate with each other.

As a result, the first piston 90 and the second piston 94 are pushed back by the biasing force of the biasing member 98 in a direction in which the pressure boosting chamber 88*a* and the second chamber 92*a* contract, which causes the fluid inside the pressure boosting chamber 88*a* to be pressurized and led out of the lead-out port 116. As described above, since it is possible to increase the pressure of the fluid by the fluid itself which is supplied to the pressure booster 10, the energy consumed by the pressure booster 10 can be reduced. Moreover, since the communicating member 160 having the communicating hole 162 is displaced to the communicating position and the interruption position by making contact with the cylinder main body 86, it is possible to simplify the configuration of the pressure booster 10.

The through hole 154 passing through the second piston 94 in the direction of the axis thereof is formed in the second piston 94. The communicating member 160 is displaced to the communicating position and the interruption position by moving in the through hole 154 in the direction of the axis. This makes it possible to displace the communicating member 160 to the communicating position and the interruption position with a simple configuration.

The communicating member 160 includes the main body portion 164 extending in the direction of the axis of the second piston 94, and the seal member 166 provided on the outer periphery of one end of the main body portion 164. The communicating hole 162 includes the first hole 168 formed on the outer periphery of the intermediate portion 164*c* of the main body portion 164, and the second hole 170 formed at the other end of the main body portion 164. In a state in which the communicating member 160 is located in the interruption position, the seal member 166 is in airtight contact with a wall surface that forms the through hole 154, and in a state in which the communicating member 160 is located in the communicating position, the seal member 166 is away from the wall surface that forms the through hole 154. This makes it possible to interrupt the communicating state between the second chamber 92*a* and the third chamber 92*b* by the seal member 166.

The main body portion 164 is configured to be located in a position closer to one side than the second piston 94 in such a way that one end face of the main body portion 164 can make contact with the cylinder main body 86 in a state in which the communicating member 160 is located in the communicating position, and the main body portion 164 is configured to be located in a position closer to the other side than the second piston 94 in such a way that the other end face of the main body portion 164 can make contact with the cylinder main body 86 in a state in which the communicating member 160 is located in the interruption position. This makes it possible to displace the communicating member 160 from the communicating position to the interruption position as a result of the one end face of the main body portion 164 making contact with the cylinder main body 86 and displace the communicating member 160 from the interruption position to the communicating position as a result of the other end face of the main body portion 164 making contact with the cylinder main body 86.

In the main body portion 164, the other end face of the main body portion 164 is located in a position closer to the other side than the second piston 94 in a state in which the communicating member 160 is located in the communicating position. The second hole 170 is formed in a side face of the other end of the main body portion 164. As a result, since the second hole 170 is formed in the side face of the other end of the main body portion 164, it is possible to prevent the communicating hole 162 from being closed by the cylinder main body 86 in a state in which the communicating member 160 is displaced from the interruption position to the communicating position as a result of the other end face of the main body portion 164 making contact with the cylinder main body 86.

The communicating member 160 includes the separation preventing portion 172 that prevents separation of the communicating member 160 from the through hole 154. This makes it possible to prevent the communicating member 160 from separating from the through hole 154 of the second piston 94.

The cylinder apparatus 12 includes: the pressure booster 10; the fluid pressure cylinder 14 having the piston 24 that divides the inside of the cylinder portion 18 into the first cylinder chamber 20 and the second cylinder chamber 22 and can reciprocate and slide in the cylinder portion 18; the supply channel 36 configured to supply the fluid to the inside of the first cylinder chamber 20; the first introduction channel 64 that guides the fluid discharged from the fluid pressure cylinder 14 to the first introduction port 112 of the pressure booster 10; the second introduction channel 66 that guides the fluid discharged from the fluid pressure cylinder 14 to the second introduction port 126 of the pressure booster 10; and the recovery channel 68 that guides the pressurized fluid led out of the lead-out port 116 of the pressure booster 10 to the supply channel 36.

The first introduction channel 64 is provided with the first check valve 74 that permits the circulation of the fluid from the first introduction channel 64 to the first introduction port 112 and checks the circulation of the fluid from the first introduction port 112 to the first introduction channel 64. The second introduction channel 66 is provided with the second check valve 76 that permits the circulation of the fluid from the second introduction channel 66 to the second introduction port 126 and checks the circulation of the fluid from the second introduction port 126 to the second introduction channel 66. The recovery channel 68 is provided with the third check valve 78 that permits the circulation of the fluid from the lead-out port 116 to the recovery channel 68 and checks the circulation of the fluid from the recovery channel 68 to the lead-out port 116. This makes it possible to pressurize the fluid inside the pressure boosting chamber 88*a* efficiently with a simple configuration.

The present invention is not limited to the above-described configuration. For example, the biasing member 98 may be disposed in the first chamber 88*b* in the pressure booster 10 to bias the first piston 90 toward the side opposite to the rod 96 by the biasing member 98.

In the pressure booster 10, the pressure boosting chamber 88*a* may be provided between the first piston 90 and the division wall 80 and the first chamber 88*b* may be provided between the first end cover 102 and the first piston 90, and the second chamber 92*a* may be provided between the second piston 94 and the second end cover 106 and the third chamber 92*b* may be provided between the second piston 94 and the division wall 80. In this case, the cylinder main body 86 is provided with the first introduction port 112 communicating with the pressure boosting chamber 88*a*, the first atmospheric port 114 communicating with the first chamber 88*b*, the second introduction port 126 communicating with the second chamber 92*a*, the second atmospheric port 128 communicating with the third chamber 92*b*, and the lead-out port 116 communicating with the pressure boosting chamber 88*a*. Moreover, the biasing member 98 is provided so as to bias at least one of the first piston 90 and the second piston 94 in a direction in which the pressure boosting chamber 88*a* contracts. This configuration also produces an effect similar to that of the above-described configuration.

It goes without saying that the pressure booster and the cylinder apparatus according to the present invention are not limited to those in the above-described embodiment and various configurations can be adopted within the scope of the present invention.

The invention claimed is:

1. A pressure booster comprising:

a cylinder main body having two cylinder chambers divided by a division wall;

a first piston slidably disposed in one cylinder chamber of the two cylinder chambers and dividing an inside of the one cylinder chamber into a pressure boosting chamber and a first chamber;

a second piston slidably disposed in another cylinder chamber of the two cylinder chambers and dividing an inside of the other cylinder chamber into a second chamber and a third chamber;

a rod provided so as to pass through the division wall and configured to couple the first piston and the second piston to each other; and a biasing member configured to bias at least one of the first piston and the second piston in a direction in which the first piston moves toward the pressure boosting chamber, wherein the cylinder main body is provided with a first introduction port configured to introduce fluid into the pressure boosting chamber, a first atmospheric port configured to make an inside of the first chamber open to an atmosphere, a second introduction port configured to introduce the fluid into the second chamber, a second atmospheric port configured to make an inside of the third chamber open to the atmosphere, and a lead-out port configured to lead the fluid pressurized in the pressure boosting chamber out of the pressure boosting chamber, the second piston is provided with a communicating member having a communicating hole configured to make the second chamber and the third chamber communicate with each other, the communicating member being configured to be displaced to a communicating position in which the second chamber and the third chamber communicate with each other via the communicating hole and an interruption position in which a communicating state between the second chamber and the third chamber is interrupted, and the communicating member is configured to be displaced from the communicating position to the interruption position as a result of the communicating member making contact with the cylinder main body when the first piston and the second piston are displaced in a direction in which the pressure boosting chamber contracts, and the communicating member is configured to be displaced from the interruption position to the communicating position as a result of the communicating member making contact with the cylinder main body when the first piston and the second piston are displaced in a direction in which the pressure boosting chamber expands.

2. The pressure booster according to claim 1, wherein a through hole passing through the second piston in a direction of an axis thereof is formed in the second piston, and the communicating member is displaced to the communicating position and the interruption position by moving in the through hole in the direction of the axis.

3. The pressure booster according to claim 2, wherein the communicating member includes a main body portion extending in the direction of the axis of the second piston, and a seal member provided on an outer periphery of one end of the main body portion, the communicating hole includes a first hole formed on an outer periphery of an intermediate portion of the main body portion, and a second hole formed at another end of the main body portion, and when the communicating member is located in the interruption position, the seal member is in airtight contact with a wall surface that forms the through hole, and when the communicating member is located in the communicating position, the seal member is away from the wall surface that forms the through hole.

4. The pressure booster according to claim 3, wherein the main body portion is movable relative to the second piston, to be located at a position closer to one side of the pressure booster than is the second piston when the communicating member is located in the communicating position so that one end face of the main body portion can make contact with the cylinder main body, and located at a position closer to another side of the pressure booster than is the second piston when the communicating member is located in the interruption position so that another end face of the main body portion can make contact with the cylinder main body.

5. The pressure booster according to claim 4, wherein in the main body portion, the other end face of the main body portion is located in a position closer to the other side than the second piston when the communicating member is located in the communicating position, and the second hole is formed in a side face of the other end of the main body portion.

6. The pressure booster according to claim 2, wherein the communicating member includes a separation preventing portion that prevents separation of the communicating member from the through hole.

7. A cylinder apparatus comprising:

the pressure booster according to claim 1;

a fluid pressure cylinder having a piston that divides an inside of a cylinder portion into a first cylinder chamber and a second cylinder chamber and that is configured to reciprocate and slide in the cylinder portion;

a supply channel configured to supply fluid to an inside of the first cylinder chamber;

a first introduction channel configured to guide the fluid discharged from the fluid pressure cylinder to the first introduction port of the pressure booster;

a second introduction channel configured to guide the fluid discharged from the fluid pressure cylinder to the second introduction port of the pressure booster; and a recovery channel configured to guide pressurized fluid led out of the lead-out port of the pressure booster to the supply channel.

8. The cylinder apparatus according to claim 7, wherein the first introduction channel is provided with a first check valve configured to permit circulation of the fluid flowing to the first introduction port from the first introduction channel and check circulation of the fluid flowing to the first introduction channel from the first introduction port, the second introduction channel is provided with a second check valve configured to permit circulation of the fluid flowing to the second introduction port from the second introduction channel and check circulation of the fluid flowing to the second introduction channel from the second introduction port, and the recovery channel is provided with a third check valve configured to permit circulation of the fluid flowing to the recovery channel from the lead-out port and check circulation of the fluid flowing to the lead-out port from the recovery channel.

* * * * *